US010086908B2

(12) United States Patent
Kato et al.

(10) Patent No.: US 10,086,908 B2
(45) Date of Patent: Oct. 2, 2018

(54) PERSONAL WATERCRAFT

(71) Applicant: Kawasaki Jukogyo Kabushiki Kaisha, Kobe-shi, Hyogo (JP)

(72) Inventors: Hironori Kato, Kakogawa (JP); Toshio Araki, Kakogawa (JP); Minoru Kanamori, Rowland Heights, CA (US)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 284 days.

(21) Appl. No.: 15/338,083

(22) Filed: Oct. 28, 2016

(65) Prior Publication Data

US 2017/0174290 A1 Jun. 22, 2017

(30) Foreign Application Priority Data

Dec. 21, 2015 (JP) ..... 2015-248326

(51) Int. Cl.
*B63B 1/00* (2006.01)
*B63B 1/04* (2006.01)
*B63B 35/73* (2006.01)

(52) U.S. Cl.
CPC ..... *B63B 1/042* (2013.01); *B63B 35/731* (2013.01)

(58) Field of Classification Search
CPC ..... B63B 1/042; B63B 35/731
See application file for complete search history.

(56) References Cited

U.S. PATENT DOCUMENTS 3,552,349 A * 1/1971 Snow ..... B63B 35/731 114/288
3,702,598 A * 11/1972 Szptyman ..... B63B 1/20 114/289
4,708,085 A * 11/1987 Blee ..... B63B 1/042 114/288
5,634,419 A * 6/1997 Cymara ..... B63B 1/042 114/56.1
6,422,168 B1 * 7/2002 Kobayashi ..... B63B 1/20 114/291
6,779,474 B2 8/2004 Nakagawa et al.
7,165,503 B2 * 1/2007 Mascellaro ..... B63B 1/20 114/290

(Continued)

FOREIGN PATENT DOCUMENTS

CN 101554918 A 10/2009

*Primary Examiner* — Stephen Avila
(74) *Attorney, Agent, or Firm* — Alleman Hall Creasman & Tuttle LLP

(57) ABSTRACT

A personal watercraft comprises a body including a deck and a hull, the hull includes a bottom surface facing downward and side surfaces facing outward in a rightward and leftward direction, the bottom surface has a shape in which a width in the rightward and leftward direction is reduced from its center portion in a forward and rearward direction to its rear portion, in a center portion of the hull in a forward and rearward direction, each of the side surfaces includes an upper side surface and a lower side surface, the lower side surface and the bottom surface are connected to each other to form an obtuse angle in a cross-section viewed from a rear, and an inclination angle formed between the lower side surface and a vertical line is set to be greater than an inclination angle formed between the upper side surface and the vertical line.

5 Claims, 4 Drawing Sheets

(56) References Cited

U.S. PATENT DOCUMENTS

| | | | | |
|---|---|---|---|---|
| 7,418,915 | B2 * | 9/2008 | Campbell | B63B 1/20 114/288 |
| 7,856,937 | B2 * | 12/2010 | Chapdelaine | B63B 23/00 114/125 |
| 8,347,802 | B2 * | 1/2013 | Pereira | B63B 35/731 114/55.54 |
| 9,038,561 | B2 * | 5/2015 | Loui | B63B 1/042 114/291 |

* cited by examiner

PERSONAL WATERCRAFT

BACKGROUND OF THE INVENTION

Field of the Invention

The present invention relates to a personal watercraft.

Description of Related Art

In an exemplary jet-propulsive personal watercraft disclosed in U.S. Pat. No. 6,779,474, an engine is placed in an engine room surrounded by a hull and a deck, and a water jet pump is driven by the engine to pressurize water suctioned through a suction port provided on the hull and eject the water in a rearward direction through a pump nozzle, thereby generating a propulsive force for moving the body.

The personal watercraft can make a smooth turn, if the body is tilted in a roll direction (rightward and leftward direction) while the direction of the pump nozzle is changed by steering a handle. However, if the body receives a high pressure from a water surface while the body is tilted, a rider cannot turn the body smoothly, and a turn radius increases against the rider's intention.

SUMMARY OF THE INVENTION

The present invention addresses the above-described conditions, and an object of the present invention is to improve the turning performance of the personal watercraft.

According to an aspect of the present invention, a personal watercraft comprises a body including a deck and a hull, wherein the hull includes a bottom surface facing downward and side surfaces facing outward in a rightward and leftward direction, wherein the bottom surface of the hull has a shape in which a width in the rightward and leftward direction is reduced from a center portion of the bottom surface in a forward and rearward direction to a rear portion of the bottom surface, wherein in a center portion of the hull in the forward and rearward direction, each of the side surfaces includes an upper side surface and a lower side surface located between the upper side surface and the bottom surface, and wherein the lower side surface and the bottom surface are connected to each other to form an obtuse angle between the lower side surface and the bottom surface in a cross-section viewed from a rear, and an inclination angle formed between the lower side surface and a vertical line is set to be greater than an inclination angle formed between the upper side surface and the vertical line.

In most cases, while the personal watercraft is turning, a pressure applied from a water surface to a bent connection portion of the side surface of the hull and the bottom surface of the hull is locally increased, which makes it difficult to tilt the body in a roll direction (rightward and leftward direction). However, in accordance with the above-described configuration, in the center portion of the hull in the forward and rearward direction, each of the side surfaces includes the upper side surface and the lower side surface, the lower side surface and the bottom surface are connected to each other to form an obtuse angle between the lower side surface and the bottom surface in the cross-section viewed from a rear, and the inclination angle formed between the lower side surface and the vertical line is set to be greater than the inclination angle formed between the upper side surface and the vertical line. In this configuration, a connection portion of each of the side surfaces and the bottom surface of the hull is bent at a small angle, and an area of a portion of the side surface of the hull which contacts the water is increased, while the personal watercraft is turning. Therefore, while the personal watercraft is turning in a state in which the body is tilted in the roll direction, a localized pressure applied from the water surface to the connection portion of each of the side surfaces and the bottom surface in the center portion of the hull in the forward and rearward direction is decentralized, which allows the body to be easily tilted in the roll direction. In addition, the width of the bottom surface of the hull in the rightward and leftward direction is reduced as it extends rearward. Therefore, while the personal watercraft is turning in a state in which the body is tilted in the roll direction, a stern immersed in the water can easily slide in the rightward and leftward direction. As should be understood from the above, by mutual effects of the shape of the center portion of the hull in the forward and rearward direction and the shape of the rear end portion of the hull, the turning performance of the personal watercraft can be improved.

The above and further objects, features and advantages of the present invention will more fully be apparent from the following detailed description of a preferred embodiment with reference to the accompanying drawings.

DETAILED DESCRIPTION OF THE PREFERRED EMBODIMENTS

Hereinafter, the embodiment of the present invention will be described with reference to the accompanying drawings. The stated directions are from the perspective of a rider riding on a personal watercraft 1.

Figure 1:
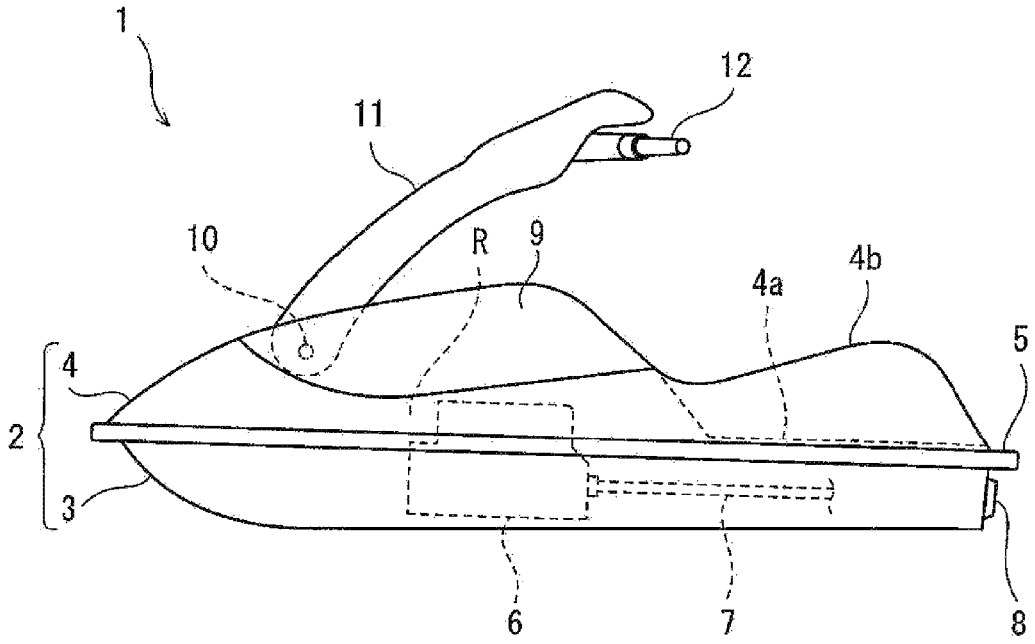
FIG. 1 is a schematic side view of a personal watercraft according to the embodiment of the present invention.

FIG. 1 is a schematic side view of the personal watercraft 1 according to the embodiment. As shown in FIG. 1, the personal watercraft 1 is a stand-up type personal watercraft which is steered by the rider in a standing position. The personal watercraft 1 includes a body 2 including an engine room R formed inside thereof. The body 2 includes a hull 3, and a deck 4 covering the hull 3 from above. A connection line of the hull 3 and the deck 4 is referred to as a gunnel line 5. An engine 6 is disposed in the engine room R. A propeller shaft 7 extends rearward in the interior of the body 2 and is connected to the output shaft of the engine 6. A water jet pump (not shown) is driven by the propeller shaft 7 of the engine E to pressurize and accelerate water suctioned through a suction port 21 (see FIG. 2) provided on the hull 3, and eject the water through a jet nozzle 8 attached to the rear end portion of the body 2, thereby generating a propulsive force for moving the body 2.

The deck 4 includes in a rear portion thereof a standing deck 4*a* having a flat floor surface on which the rider stands, at a location that is rearward relative to the engine room R. The standing deck 4*a* is located to be lower than the upper end of the engine room R. Deck fins 4*b* are provided on the right and left sides of the standing deck 4*a*, respectively. The deck fins 4*b* are side walls protruding upward. The deck 4 is formed with a maintenance opening (not shown) placed above the engine E. The maintenance opening is in communication with the engine room R. An engine hood 9 is removably mounted to the deck 4 to cover the maintenance opening from above.

A hinge member 10 is fastened to the upper surface of the deck 4 at a location that is in front of the maintenance opening. The front end portion of a handle pole 11 is attached to the hinge member 10 in such a manner that the handle pole 11 is rotatable around an axis extending in a rightward and leftward direction. The rear end portion of the handle pole 11 is provided with a bar-type steering handle 12. The center portion in the rightward and leftward direction of the upper surface of the engine hood 9 is formed with a groove (not shown) extending in a forward and rearward direction. The handle pole 11 is accommodated in the groove, in a state in which the rider is not gripping the steering handle 12. The rider stands on the standing deck 4*a*, grips the steering handle 12, and raises the handle pole 11 up. In this state, the rider steers the personal watercraft 1.

Figure 2:
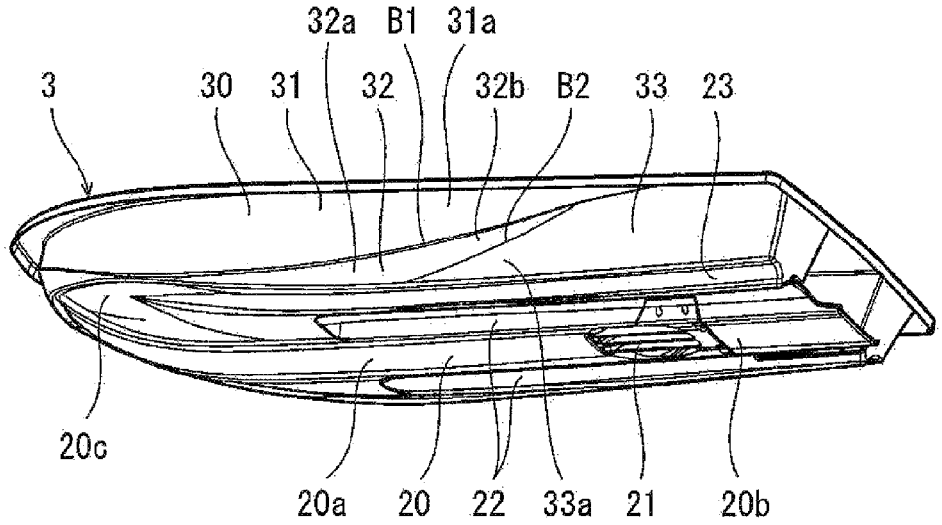
FIG. 2 is a perspective view of a hull of the personal watercraft of FIG. 1, when viewed from the obliquely left and below.
Figure 3:
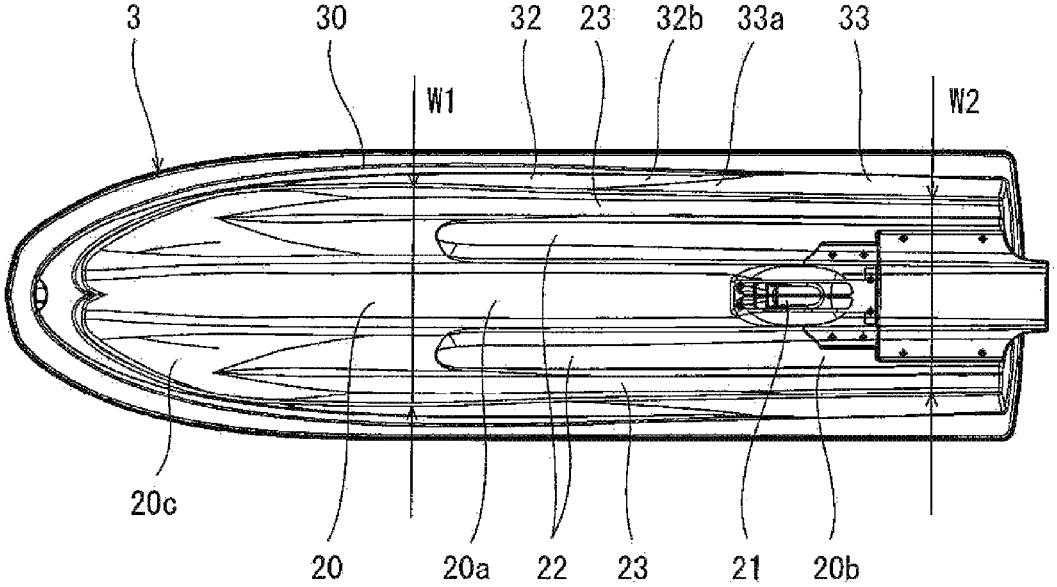
FIG. 3 is a bottom view of the hull of FIG. 2.
Figure 4:
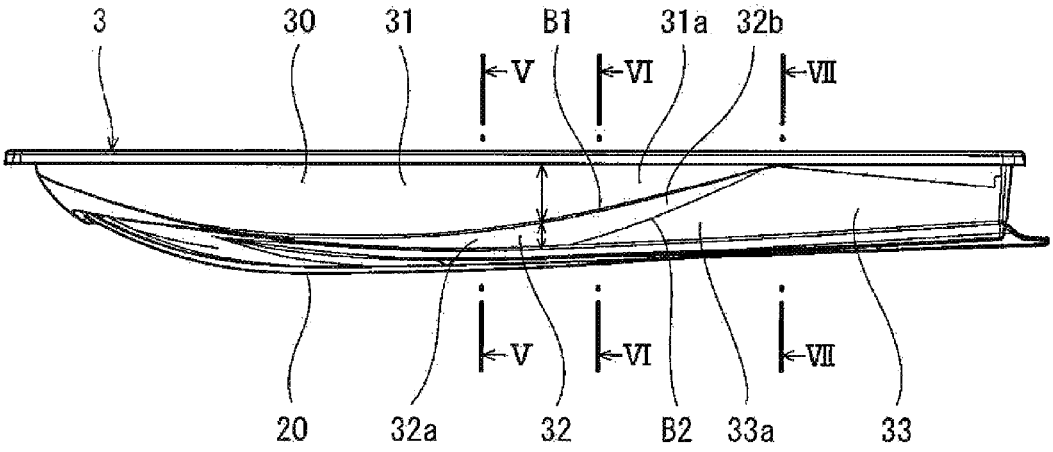
FIG. 4 is a side view of the hull of FIG. 2.
Figure 5:
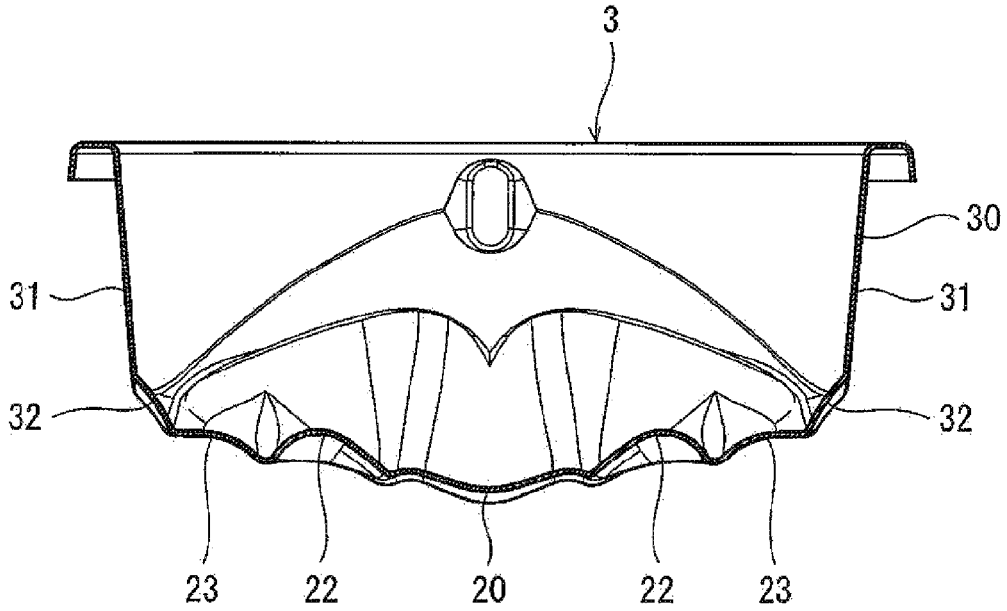
FIG. 5 is a cross-sectional view taken along line V-V of FIG. 4.
Figure 6:
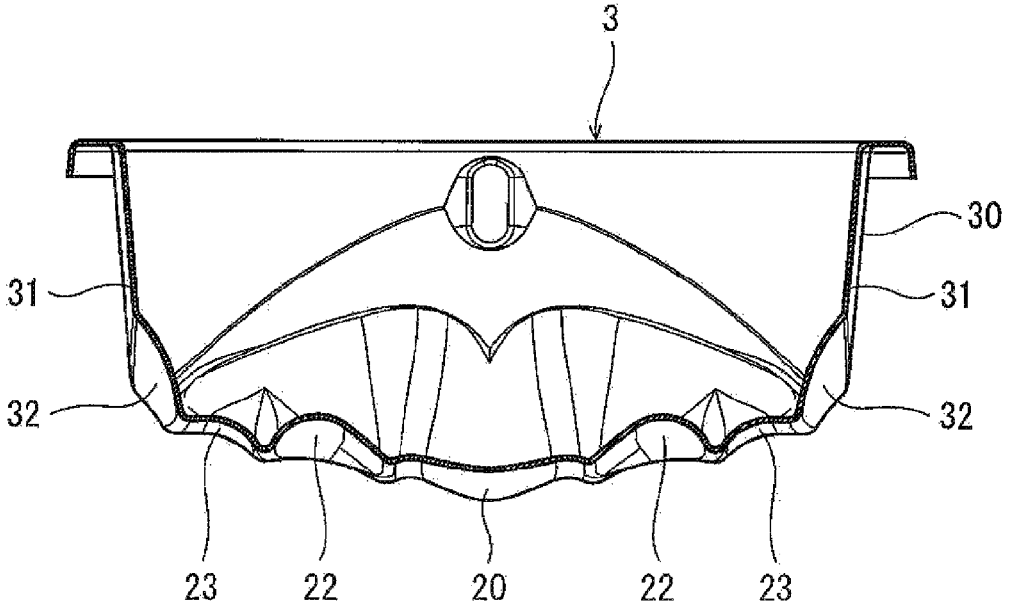
FIG. 6 is a cross-sectional view taken along line VI-VI of FIG. 4.
Figure 7:
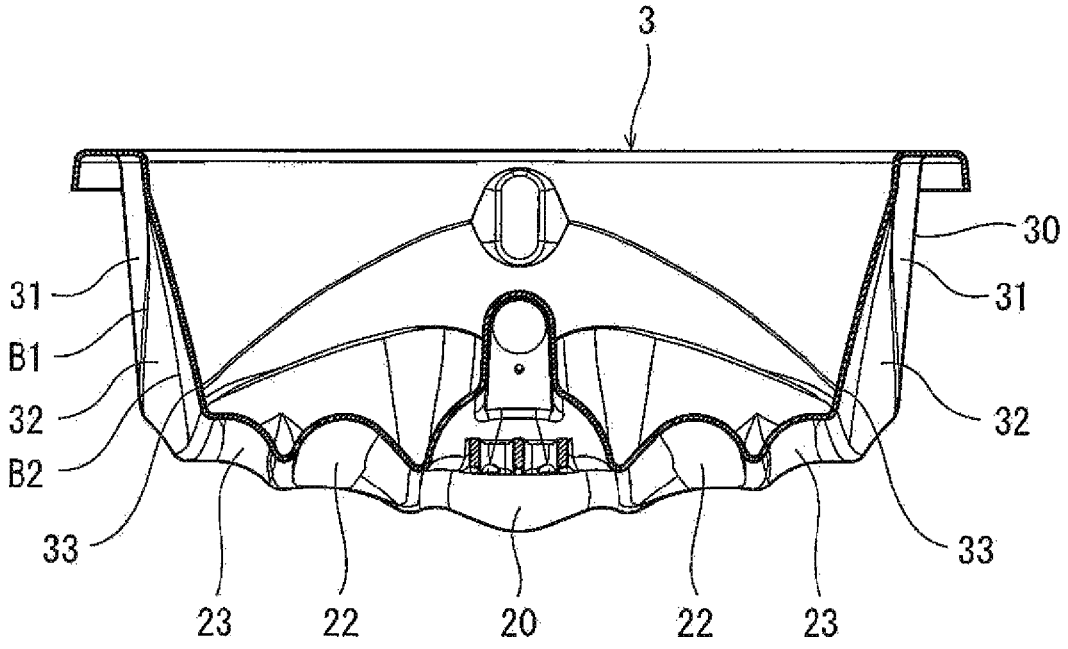
FIG. 7 is a cross-sectional view taken along line VII-VII of FIG. 4.

FIG. 2 is a perspective view of the hull 3 of the personal watercraft 1 of FIG. 1, when viewed from the obliquely left and below. FIG. 3 is a bottom view of the hull 3 of FIG. 2. FIG. 4 is a side view of the hull 3 of FIG. 2. FIG. 5 is a cross-sectional view taken along lines V-V of FIG. 4. FIG. 6 is a cross-sectional view taken along lines VI-VI of FIG. 4. FIG. 7 is a cross-sectional view taken along lines VII-VII of FIG. 4. Referring to FIGS. 2 to 7, the hull 3 includes a bottom surface 20 facing downward, and side surfaces 30 facing outward in the rightward and leftward direction. In the present embodiment, when viewed from the forward and rearward direction, the bottom surface 20 is inclined in such a manner that an angle formed between the bottom surface 20 and a horizontal plane is set to be smaller than that formed between the bottom surface 20 and a vertical plane. More specifically, when viewed from the forward and rearward direction, the bottom surface 20 forms an angle of 0 to 45 degrees with respect to the horizontal place. In contrast, when viewed from the forward and rearward direction, the side surfaces 30 are inclined in such a manner that an angle formed between each of the side surfaces 30 and the horizontal plane is set to be greater than that formed between the side surface 30 and the vertical plane. More specifically, when viewed from the forward and rearward direction, the side surfaces 30 form an angle of 45 degrees to 90 degrees with respect to the horizontal place. In the present embodiment, the angle of the surface is defined as the average of angles of tangent at points of a region sandwiched between a pair of bent portions, in a cross-section viewed from the forward and rearward direction.

The suction port 21 is provided at the center of the rear portion of the bottom surface 20. In a cross-section viewed from the rear, the bottom surface 20 includes a pair of guide groove surfaces 22 which are recessed in an upward direction in an arc-shape. The pair of guide groove surfaces 22 extend in the forward and rearward direction from a center portion 20*a* of the bottom surface 20 in the forward and rearward direction toward a rear end thereof, on the right and left sides of the suction port 21, respectively. The bottom surface 20 includes lateral end bottom surfaces 23, each of which is provided between the side surface 30 and the guide groove surface 22 and extends in the forward and rearward direction and continuously with the side surface 30 and the guide groove surface 22. The bottom surface 20 has a shape in which a width in the rightward and leftward direction is smaller from the center portion 20*a* in the forward and rearward direction toward a front portion 20*c* thereof. The bottom surface 20 also has a shape in which the width in the rightward and leftward direction is made smaller from the center portion 20*a* in the forward and rearward direction toward a rear portion 20*b* thereof. More specifically, the bottom surface 20 has a shape in which the width W2 in the rightward and leftward direction of the rear portion 20*b* is equal to or greater than 80% and equal to or less than 90% of a maximum width W1 in the rightward and leftward direction of the width of the center portion 20*a*. In the present embodiment, the center portion 20*a* of the bottom surface 20 is defined to include at least a region from a 40% position of the hull 3 to a 55% position of the hull 3, when the front end position of the hull 3 in the forward and rearward direction is expressed as a 0% position and the rear end position of the hull 3 in the forward and rearward direction is expressed as a 100% position.

In the center portion of the hull 3 in the forward and rearward direction, each of the side surfaces 30 includes an upper side surface 31 and a lower side surface 32 located between the upper side surface 31 and the bottom surface 20. A front region 32*a* of the lower side surface 32 is continuous with the upper side surface 31 and the bottom surface 20. The front region 32*a* of the lower side surface 32 and the bottom surface 20 are connected to each other to form an obtuse angle between them in a cross-section viewed from the rear. An inclination angle formed between the lower side surface 32 and a vertical line is set to be greater than an inclination angle formed between the upper side surface 31 and the vertical line. A vertical length L2 of the lower side surface 32 is shorter than a vertical length L1 of the upper side surface 31. A boundary B1 between the upper side surface 31 and the lower side surface 32 extends obliquely rearward and upward.

The rear region 31*a* of the upper side surface 31 extends rearward and upward. The rear region 31*a* of the upper side surface 31 has a shape in which a vertical dimension is gradually reduced as it extends rearward. The rear region 32*b* of the lower side surface 32 extends rearward and upward. The rear region 32*b* of the lower side surface 32 has a shape in which a vertical dimension is gradually reduced as it extends rearward. The rear region 32*b* of the lower side surface 32 faces outward in the rightward and leftward direction, rearward and downward. More specifically, the rear region 32*b* of the lower side surface 32 is inclined with respect to the upper side surface 31 in such a manner that its normal line faces outward in the rightward and leftward direction, rearward and downward.

Each of the side surfaces 30 includes a rear side surface 33 in the rear portion of the hull 3. An inclination angle formed between the rear side surface 33 and the vertical line is set to be smaller than an inclination angle formed between the lower side surface 32 and the vertical line. The rear side surface 33 of the rear portion of the hull 3 is located inward in the rightward and leftward direction relative to the upper side surface 31 and the lower side surface 32 of the center portion of the hull 3. A front region 33*a* of the rear side surface 33 extends forward and downward. The front region 33*a* of the rear side surface 33 has a shape in which its vertical dimension is gradually reduced as it extends forward. The front region 33*a* of the rear side surface 33 overlaps with the rear region 32*b* of the lower side surface 32 in the forward and rearward direction, and is located below the rear region 32*b* of the lower side surface 32. A boundary B2 between the lower side surface 32 and the rear side surface 33 extends obliquely rearward and upward.

In accordance with the above-described configuration, in the center portion of the hull 3 in the forward and rearward direction, each of the side surfaces 30 of the hull 3 includes the upper side surface 31 and the lower side surface 32, the lower side surface 32 and the bottom surface 20 are connected to each other to form the obtuse angle between them in the cross-section viewed from the rear, and the inclination angle formed between the lower side surface 32 of the side surface 30 and the vertical line is set to be greater than that formed between the upper side surface 31 of the side surface 30 and the vertical line. In this configuration, a connection portion of each of the side surfaces 30 and the bottom surface 20 is bent at a small angle, and an area of a portion of the side surface 30 of the hull 3 which contacts the water is increased, while the personal watercraft 1 is turning. Therefore, while the personal watercraft 1 is turning in a state in which the body 2 is tilted in a roll direction (rightward and leftward direction), a localized pressure applied from the water pressure to the connection portion of each of the side surfaces 30 and the bottom surface 20 in the center portion 20*a* of the hull 3 in the forward and rearward direction is decentralized, which allows the body 2 to be easily tilted in the roll direction. In addition, the width of the bottom surface 20 of the hull 3 in the rightward and leftward direction is reduced as it extends rearward. Therefore, while the personal watercraft 1 is turning in a state in which the body 2 is tilted in the roll direction, a stern immersed in the water can easily slide in the rightward and leftward direction. As should be understood from the above, by mutual effects of the shape of the center portion of the hull 3 in the forward and rearward direction and the shape of the rear end portion of the hull 3, the turning performance of the personal watercraft 1 can be improved.

In addition, since the rear region 32*b* of the lower side surface 32 extends rearward and upward, it becomes possible to reduce a fluctuation in a resistance which occurs while the body 2 is gradually tilted in the roll direction. Further, since the rear region 32*b* of the lower side surface 32 faces outward in the rightward and leftward direction, rearward and downward, the water pushed by the lower side surface 32 smoothly flows, while the body 2 is moving in a state in which the body 2 is gradually tilted in the roll direction. Therefore, the turning performance of the personal watercraft 1 can be further improved. Moreover, since the vertical length L2 of the lower side surface 32 of the side surface 30 is shorter than the vertical length L1 of the upper side surface 31 of the side surface 30, the upper side surface 31 can sufficiently suppress an oscillation of the body 2 in the rightward and leftward direction while the personal watercraft 1 is moving straight.

Numerous improvements and alternative embodiment of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the scope of the invention.

The invention claimed is:

1. A personal watercraft comprising:

a body including a deck and a hull, wherein the hull includes a bottom surface facing downward and side surfaces facing outward in a rightward and leftward direction, wherein the bottom surface of the hull has a shape in which a width in the rightward and leftward direction is reduced from a center portion of the bottom surface in a forward and rearward direction to a rear portion of the bottom surface, wherein in a center portion of the hull in the forward and rearward direction, each of the side surfaces includes an upper side surface and a lower side surface located between the upper side surface and the bottom surface, and wherein the lower side surface and the bottom surface are connected to each other to form an obtuse angle between the lower side surface and the bottom surface in a cross-section viewed from a rear, and an inclination angle formed between the lower side surface and a vertical line is set to be greater than an inclination angle formed between the upper side surface and the vertical line.

2. The personal watercraft according to claim 1, wherein a vertical length of the lower side surface of each of the side surfaces is set to be shorter than a vertical length of the upper side surface of each of the side surfaces.

3. The personal watercraft according to claim 1, wherein a boundary between the upper side surface of each of the side surfaces and the lower side surface of each of the side surfaces extends rearward and upward.

4. The personal watercraft according to claim 1, wherein the bottom surface of the hull includes a pair of guide groove surfaces which extend from the center portion of the bottom surface toward a rear end of the bottom surface, and are recessed in an upward direction, in the cross-section viewed from the rear, and wherein the bottom surface includes a pair of lateral end bottom surfaces, each of which is provided between the lower side surface and the guide groove surface.

5. The personal watercraft according to claim 1, wherein the rear portion of the bottom surface has a width in the rightward and leftward direction that is 90% or less of a maximum value of the width in the rightward and leftward direction of the bottom surface.

* * * * *